United States Patent [19]

Condon

[11] Patent Number: 5,022,559

[45] Date of Patent: Jun. 11, 1991

[54] LIQUID DISPENSING CONTAINER

[76] Inventor: Duane R. Condon, 2330 Raymond Ave., Ramona, Calif. 92065

[21] Appl. No.: 482,269

[22] Filed: Feb. 20, 1990

[51] Int. Cl.[5] ..... B67D 1/16

[52] U.S. Cl. ..... 222/109; 15/104.94; 206/15.3; 401/122; 401/129

[58] Field of Search ..... 222/187, 109; 15/104.93, 104.94; 206/15.2, 15.3; 401/207, 129, 126, 130, 121, 122, 290

[56] References Cited

U.S. PATENT DOCUMENTS

| | | | |
|---|---|---|---|
| 48,508 | 7/1865 | Boughton | 206/15.3 |
| 367,397 | 1/1888 | Rowland . | |
| 551,783 | 12/1895 | Musgrove . | |
| 580,013 | 4/1897 | Smith . | |
| 598,474 | 2/1898 | Daniels | 401/129 X |
| 1,254,714 | 1/1918 | McCombs | 401/129 |
| 1,687,179 | 10/1928 | Peterson | 206/15.3 |
| 1,715,144 | 5/1929 | Paulson . | |
| 1,959,441 | 5/1934 | Oscar | 401/129 |
| 2,058,203 | 10/1936 | Ashley . | |
| 2,783,489 | 5/1957 | Bogoslowsky . | |

FOREIGN PATENT DOCUMENTS

| | | | |
|---|---|---|---|
| 430437 | 6/1911 | France . | |
| 1070381 | 7/1954 | France | 401/122 |

*Primary Examiner*—Michael S. Huppert
*Assistant Examiner*—Gregory L. Huson
*Attorney, Agent, or Firm*—Baker, Maxham, Jester & Meador

[57] ABSTRACT

An apparatus for dispensing liquids or viscous fluids, especially ABS and PVC type cement, includes an upwardly opening container having a large externally threaded mouth that communicates with an interior of the container. A downwardly converging well is positioned in the mouth and has a hole extending through a lower end thereof so that the well communicates with the interior of the container. The well acts as a funnel when the container is filled. An elongated brush or other applicator member is adapted to be inserted through the hole in the well and has an upper handle portion, a lower applicator and an intermediate enlarged intermediate portion that engages the portion of the well defining the hole to cover the same. An internally threaded cap screws over the mouth of the container and has a large central opening that communicates with the well. A clasp on the cap holds the handle portion and presses the enlarged intermediate portion of the applicator member against the well to thereby seal the interior of the container. This minimizes the escape of harmful vapors from the interior of the container and prevents spillage of the contents thereof if the container is accidentally tipped over.

10 Claims, 2 Drawing Sheets

FIG. 1
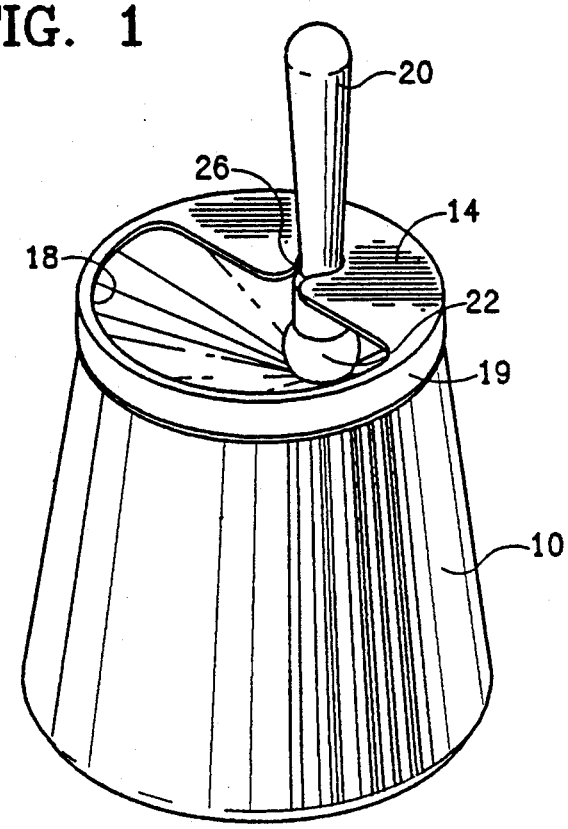
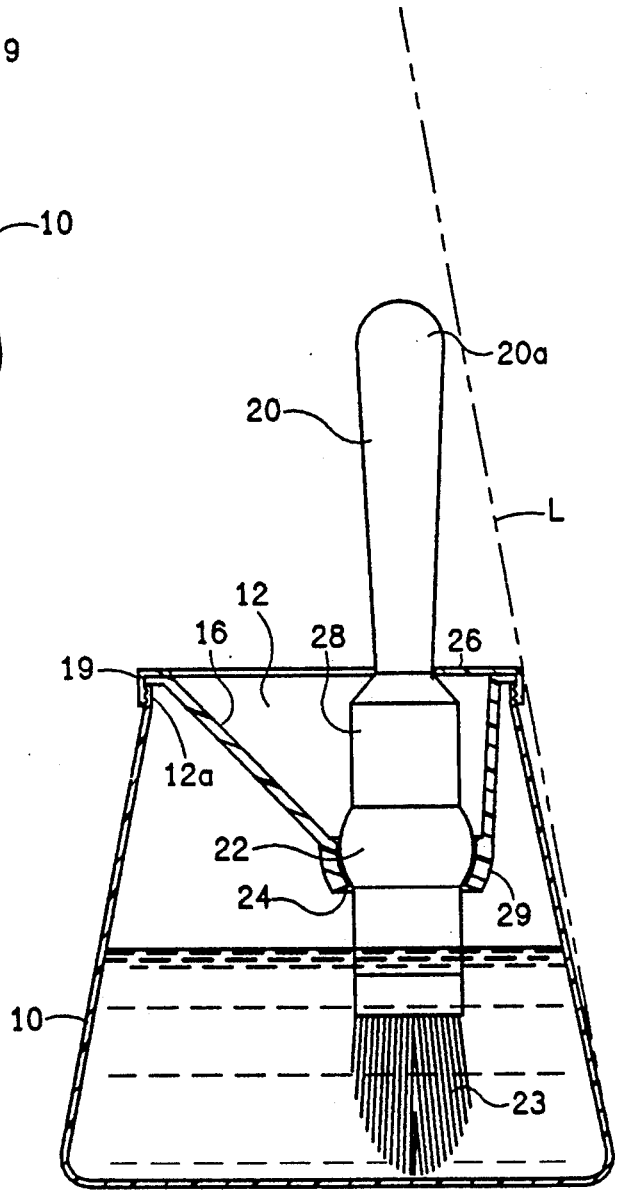
FIG. 2

FIG. 3
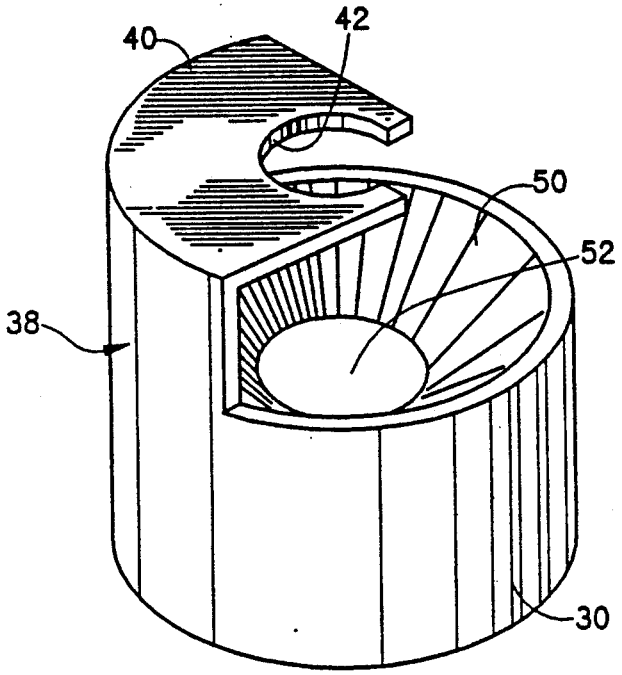
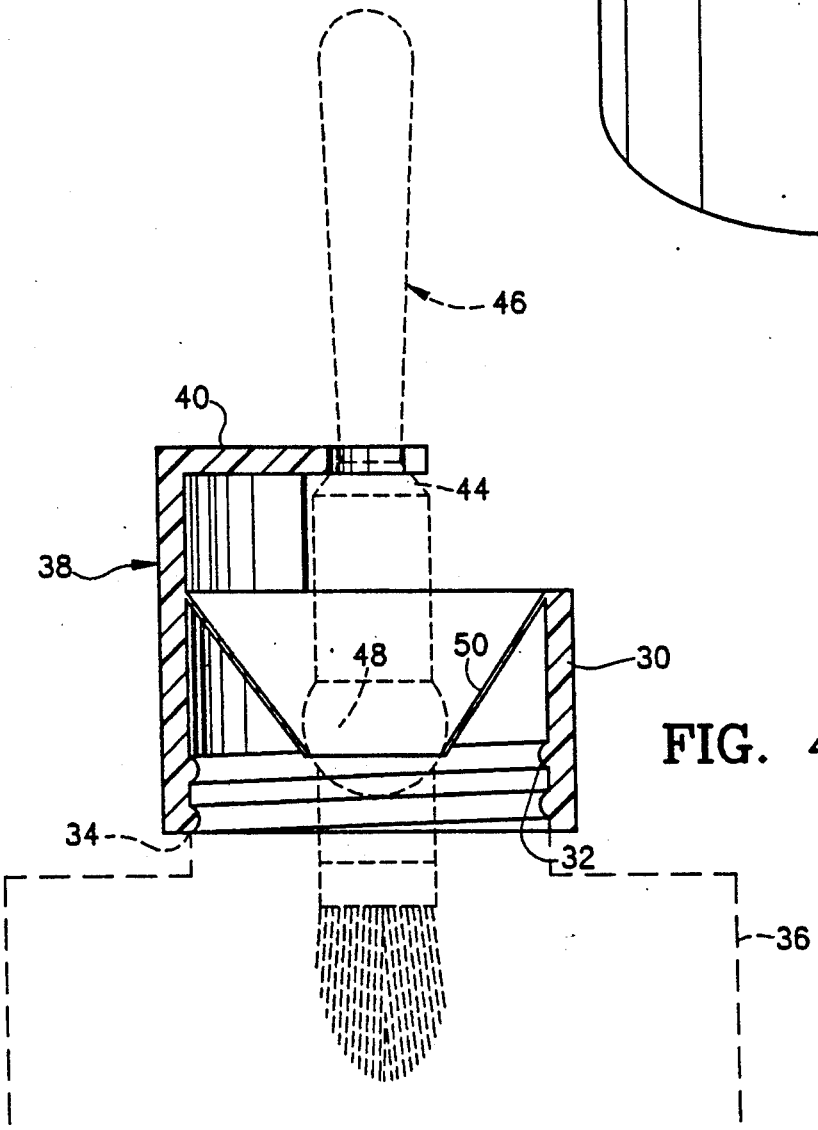
FIG. 4

LIQUID DISPENSING CONTAINER

BACKGROUND OF THE INVENTION

The present invention relates to containers for dispensing liquids and other viscous fluids used primarily in the building trades, and more particularly, to such containers that have brushes or other applicators.

Plumbers frequently use PVC and ABS type cement or adhesive in bonding pipe and pipe fittings made of these plastics. Such adhesives are required by law to be shipped in metal containers because of their tendency to give off harmful vapors and because of their flammability. One type of adhesive widely used to bond ABS waste and vent pipe to pipe fittings therefor meets or exceeds ASTM-D-2235. This type of adhesive contains methyl ethyl ketone which has a relatively high vapor pressure at ambient temperature. Prolonged breathing of the vapors given off by this type of adhesive at high concentration levels is potentially harmful to the plumber's health. Furthermore, increasingly stringent governmental air quality standards put severe limits on the amount of such chemicals that are allowed to be expelled into the atmosphere.

ABS and PVC type-adhesives are typically sold in metal glue pots that have threaded caps which have brushes, dobbers or other applicators permanently affixed thereto. Such a glue pot is cumbersome to use. The threaded mouth of such a glue pot soon becomes encrusted with dried adhesive, making it difficult, if not impossible, to screw on the cap. When joining pipes and pipe fittings, the plumber typically does not have two free hands, so he cannot screw on the cap after each glue application, thus allowing potentially harmful vapors to escape. If such a container is left unsealed during a hot day, the adhesive in the container can begin to harden. Also, conventional metal glue pots are frequently knocked over by a plumber resulting in spillage of the adhesive onto the surrounding work area. This results in substantial potentially harmful vapors, lost time due to the ensuing clean up and added cost due to the necessary replacement of the relatively expensive adhesive. The same types of problems are encountered with a wide variety of other liquids dispensed in the building trade such as liquid solder flux, paints, solvents, etc.

SUMMARY OF THE INVENTION

It is therefore the primary object of the present invention to provide an improved container for dispensing liquids and viscous fluids.

It is another object of the present invention to provide an improved glue pot.

It is still another object of the present invention to provide an improved glue pot that more readily seals its contents.

It is yet another object of the present invention to provide a glue pot that will not spill its contents when accidentally tipped over.

It is yet another object of the present invention to provide an improved glue pot that will minimize the amount of harmful vapors that can escape therefrom when in use.

It is still another object of the present invention to provide an improved glue pot that can be readily refilled.

Yet another object of my invention is to provide an adaptor that can be used to retrofit existing glue pots and other liquid containers to achieve many of the aforementioned objects.

According to the present invention an apparatus is provided for dispensing liquids or viscous fluids. It includes an upwardly-opening container having a mouth that communicates with an interior. A downwardly converging well is positioned in the mouth and has a hole extending through a lower end thereof so that the well communicates with the interior of the container. An elongated applicator member is adapted to be inserted through the hole in the well and has an upper handle portion, a lower applicator and an enlarged intermediate portion that engages the portion of the well defining the hole to cover the same. A clasp connected to the container releasably holds the handle portion and presses the enlarged intermediate portion against the well to seal the interior of the container. This minimizes the escape of vapors from the interior of the container and prevents spillage of the contents thereof if the container is accidentally tipped over.

BRIEF DESCRIPTION OF THE DRAWINGS

FIG. 1 is a perspective view of a first embodiment of my invention.

FIG. 2 is a vertical sectional view of the first embodiment.

FIG. 3 is a perspective view of the cap portion of a second embodiment of my invention intended for retrofitting existing glue pots.

FIG. 4 is a vertical sectional view of the cap portion of the second embodiment illustrating in phantom lines its applicator member and its cooperation with the threaded neck of a can.

DESCRIPTION OF THE PREFERRED EMBODIMENTS

Referring to FIGS. 1 and 2, a first embodiment of my glue pot includes an upwardly-opening tapered plastic container 10 with a large externally threaded mouth 12. A large cap 14 has internal threads for screwing over the mouth 12. A conical-shaped eccentric well 16 extends downwardly from a large central opening 18 in the cap. The central opening 18 communicates with the upper end of the well. A peripheral edge or lip 19 of the cap overlaps the upper portion 12*a* of the container defining its mouth 12. Thus the well can be inserted into the mouth, and the cap screwed on to hold the well in position.

An elongated brush-type applicator member 20 is provided with a rounded intermediate portion 22 between its applicator (bristles 23) and its handle portion 20*a*. The bristles of the applicator member can be inserted through a hole 24 at the lower end of the well 16. The ball 22 is large enough in diameter so that it will not pass through but will instead seal the hole 24 in the well 16. The handle portion 20*a* of the applicator member is releasably snapped into a clasp structure 26 formed in the cap. The lower segment 28 of the handle portion has a larger diameter so that it cannot rise through the clasp structure. The length of the lower segment 28 is great enough so that the rounded intermediate portion 22 will be held tightly against a rounded lower portion 29 of the well 16 defining the hole 24. The lower portion 29 of the well 16 is rounded with a radius closely approximating that of the intermediate portion 22 of the applicator member 20. This results in a more extensive surface contact between the two that improves the seal provided thereby. The well 16 is eccentric in that it opens downwardly to position the applicator member 20 to one side of the container.

The primary use for the glue pot of FIGS. 1 and 2 is ABS or PVC type adhesive for bonding plastic pipe and fittings. However, a wide variety of other liquids and viscous fluids could be dispensed such as liquid solder flux, paint, solvents, medicines etc. The well 16 serves as a funnel to permit easy filling from a large metal can of glue. The eccentricity of the well provides a larger opening that makes it easier to fill the container 10 from a large metal can. The downwardly converging shape of the well guides the brush-type applicator through the hole 24 at the lower end of the well. It also serves as a drain to guide excess adhesive back into the interior of the container.

The tight seal provided by the rounded intermediate portion 22 keeps the glue from drying out, and prevents the escape of harmful vapors. In the case of medications, the tight seal minimizes the entry of contaminants. If the container tips over, the brush stays in place due to the clasp structure and glue will not be spilled. This is particularly important for plumbers and sprinkler installers since they are often working in rough sites and can kick over the container. The brush-type applicator can be removed and replaced (sealed) with only one hand. Existing metal glue pots require two hands to screw shut. The taper of my container provides a low center of gravity to help prevent accidental tipping. The container is made of polyethylene since almost no glues will stick to such plastic. The length of the vertically secured handle portion 20*a* is short enough so that it remains within the boundary line L (FIG. 2) defined by the extension of the tapered outer well of the container 10. Thus, the handle portion will not be dislodged from the clasp if the container falls on its side.

A second embodiment of my invention illustrated in FIGS. 3 and 4 comprises an adaptor for retrofitting existing glue cans or other conventional liquid containers. A cap portion of the adaptor includes a cylinder 30 with a lower internally threaded annular wall 32 for screwing over the externally threaded neck 34 of a conventional metal glue can 36. A clasp structure 38 extends upwardly from the cylinder 30 and includes a planar wall 40 having an arcuate recess 42 for receiving the narrowed section of a handle portion 44 of an applicator member 46. A ball 48 of the applicator member is positioned in a conical well 50 located inside the cylinder 30. The ball seals an opening 52 in the lower end of the well.

While I have described preferred embodiments of my glue pot and adaptor, it should be understood that modifications and adaptations thereof will occur to persons skilled in the art. Therefore, the protection afforded my invention should only be limited in accordance with the scope of the following claims.

I claim:

1. An apparatus for dispensing liquids or viscous fluids, comprising:

an upwardly-opening container having a mouth that communicates with an interior;

a downwardly converging well having an upper end that extends across substantially an entire width of the mouth and having a portion defining a hole extending through a lower end thereof so that the well communicates with the interior of the container;

elongated applicator means adapted to be inserted through the hole in the well and having an upper handle portion, a lower applicator and an enlarged intermediate portion with a lower rounded end configured to engage the portion of the well defining the hole to cover the same; and cap means removeably mounted over the mouth of the container and having an opening therethrough sized to expose a substantial portion of the upper end of the well and including portions defining a clasp recess sized positioned for receiving the handle portion of the applicator means so that it can be releasably snapped into the recess with the intermediate portion therebelow, the distance between a bottom of the clasp recess and the portion of the well defining the hole being less than a length of the intermediate portion such that the cap means provides a compression force on the intermediate portion to press the intermediate portion against the well, whereby the interior of the container will be sealed to thereby minimize the escape of vapors from the interior of the container and spillage of the contents of the container will be prevented if the container is accidentally tipped over.

2. An apparatus according to claim 1 wherein container has an externally threaded portion that defines the mouth and cap means includes internal threadeds cap that screw over the externally threaded portion of the container.

3. An apparatus according to claim 1 wherein the applicator is a plurality of bristles.

4. An apparatus according to claim 1 wherein the container and well are made of polyethylene.

5. An apparatus according to claim 1 wherein the container is upwardly tapered to reduce the likelihood of the same being accidentally tipped over.

6. An apparatus according to claim 1 wherein an upper peripheral edge of the well overlaps a portion of the container that defines the mouth.

7. An apparatus according to claim 1 wherein the well has a generally conical shape.

8. An apparatus according to claim 7 wherein the well has an eccentric shape and the hole in the lower end of the well is positioned on one side of the container.

9. An apparatus according to claim 1 wherein the intermediate portion of the applicator means is spherically shaped.

10. An apparatus according to claim 9 wherein the lower end of the well is rounded and receives the spherically shaped intermediate enlarged portion of the applicator means.

* * * * *

UNITED STATES PATENT AND TRADEMARK OFFICE

CERTIFICATE OF CORRECTION

PATENT NO. : 5,022,559

DATED : June 11, 1991

INVENTOR(S) : Duane R. Condon

It is certified that error appears in the above-identified patent and that said Letters Patent is hereby corrected as shown below:

In Claim 1, in column 4, line 19, after "sized" insert --and--.

In Claim 2, in column 4, line 35, after "the mouth and" insert --the-- and delete "threadeds" and insert --threads--, and in line 36 delete "cap".

Signed and Sealed this

Eighth Day of December, 1992

*Attest:*

DOUGLAS B. COMER

*Attesting Officer*

*Acting Commissioner of Patents and Trademarks*